US010550608B2

(12) United States Patent
Lam

(10) Patent No.: US 10,550,608 B2
(45) Date of Patent: Feb. 4, 2020

(54) MULTIPLE CONFIGURATION LOCK

(71) Applicant: CONAIR CORPORATION, Stamford, CT (US)

(72) Inventor: Ka Leong Lam, Tseung Kwan O (HK)

(73) Assignee: Conair Corporation, Stamford, CT (US)

( * ) Notice: Subject to any disclaimer, the term of this patent is extended or adjusted under 35 U.S.C. 154(b) by 75 days.

(21) Appl. No.: 15/842,052

(22) Filed: Dec. 14, 2017

(65) Prior Publication Data

US 2019/0186174 A1 Jun. 20, 2019

(51) Int. Cl.

| | |
|---|---|
| ***E05B 67/00*** | (2006.01) |
| ***E05B 73/00*** | (2006.01) |
| ***E05B 37/02*** | (2006.01) |
| *E05B 37/00* | (2006.01) |

(52) U.S. Cl.

CPC ..... *E05B 67/003* (2013.01); *E05B 37/02* (2013.01); *E05B 73/0005* (2013.01); *E05B 37/0055* (2013.01)

(58) Field of Classification Search

CPC ..... E05B 67/00; E05B 71/00; E05B 73/00; E05B 73/0005

See application file for complete search history.

(56) References Cited

U.S. PATENT DOCUMENTS

| | | | | |
|---|---|---|---|---|
| 539,650 | A * | 5/1895 | Searle | E05B 75/00 70/16 |
| 1,384,561 | A * | 7/1921 | Hampton | E05B 67/003 70/49 |
| 2,440,012 | A * | 4/1948 | Haver | G09F 3/0352 24/116 A |
| 2,623,378 | A * | 12/1952 | Haver | B65D 77/185 24/115 R |
| 4,850,207 | A * | 7/1989 | Ylven | B62H 5/003 70/49 |
| 5,136,864 | A | 8/1992 | Spiekermann et al. | |
| 5,557,954 | A | 9/1996 | Ling | |
| 5,689,979 | A | 11/1997 | Yu | |
| 5,927,110 | A | 7/1999 | Yu | |
| D439,825 | S | 4/2001 | Lai | |
| D448,273 | S | 9/2001 | Lai | |
| 6,408,660 | B1 | 6/2002 | Lai | |
| 7,200,901 | B2 | 4/2007 | Pitts et al. | |
| D549,552 | S | 8/2007 | Huang | |
| 7,264,287 | B2 | 9/2007 | Ching | |
| 7,631,524 | B2 | 12/2009 | Araujo | |
| 7,685,851 | B2 | 3/2010 | Lai | |
| 8,528,371 | B2 | 9/2013 | Spiegel et al. | |
| D691,457 | S | 10/2013 | Wang | |
| D691,869 | S | 10/2013 | Plato | |
| 8,650,724 | B2 | 2/2014 | King et al. | |

(Continued)

*Primary Examiner* — Christopher J Boswell

(74) *Attorney, Agent, or Firm* — Lawrence Cruz, Esq.; Ryan, Mason & Lewis, LLP

(57) ABSTRACT

A portable lock apparatus is adaptable to readily transform between a single cable loop configuration or a double cable loop configuration, and incorporates a locking mechanism permitting selective release and securement of one or more cable ends to achieve either configuration. The lock apparatus may secure multiple components, particularly, when in the double cable loop configuration, thereby removing the need for multiple locks for securing a single article.

20 Claims, 11 Drawing Sheets

(56) References Cited

U.S. PATENT DOCUMENTS

| | | | | |
|---|---|---|---|---|
| 8,661,861 | B2 | 3/2014 | Lai | |
| 8,813,528 | B2 * | 8/2014 | Olear | E05B 73/0005 70/14 |
| D739,706 | S | 9/2015 | Klaus | |
| 9,428,941 | B1 | 8/2016 | Yang | |
| 9,512,647 | B2 | 12/2016 | Meersschaert et al. | |
| 9,629,423 | B2 | 4/2017 | Schlipper | |
| 9,739,076 | B2 | 8/2017 | Dunn | |
| 2005/0035605 | A1 | 2/2005 | Vanderwater-Piercy | |
| 2005/0061038 | A1 | 3/2005 | Ling et al. | |
| 2005/0235705 | A1 | 10/2005 | Ling et al. | |
| 2006/0006035 | A1 | 1/2006 | Liang | |
| 2008/0209956 | A1 | 9/2008 | Araujo | |
| 2009/0301145 | A1 | 12/2009 | Valerio | |
| 2011/0138866 | A1 | 6/2011 | Ponicall | |
| 2013/0264128 | A1 | 10/2013 | Plato et al. | |
| 2015/0300049 | A1 | 10/2015 | Majeau | |
| 2017/0020238 | A1 | 1/2017 | Cowdery et al. | |
| 2017/0020239 | A1 | 1/2017 | Cowdery et al. | |
| 2018/0230713 | A1 * | 8/2018 | Sidhu | E05B 49/00 |
| 2019/0017294 | A1 * | 1/2019 | Sternlight | E05B 73/0005 |

* cited by examiner

MULTIPLE CONFIGURATION LOCK

BACKGROUND

1. Technical Field

The present disclosure relates to a lock apparatus, and, in particular, relates to a small portable lock apparatus adapted to transform between single cable loop and double cable loop configurations to selectively secure one or more personal articles.

2. Discussion of Related Art

Portable locks are utilized to secure items and/or articles to prevent theft of the internal components therein. For example, one portable lock may be used with luggage to secure the zipper ends to prevent the luggage from being opened during travel. Portable locks may be "key operated" or "combination" locks incorporating combination dials which are selectively rotated to assume a desired combination to release the locking components.

Although generally useful for their intended purposes, these known locks are deficient with regard to their adaptability in accommodating a variety of different sized or arranged articles, and often necessitate the use of multiple locks to appropriately secure the article(s).

SUMMARY

Accordingly, the present disclosure is directed to further improvements in portable locks. In general, the lock apparatus of the present disclosure is adaptable to readily transform between a single cable loop configuration or a double cable loop configuration, and incorporates a locking mechanism permitting selective release and securement of one or more cable ends to achieve either configuration. The lock apparatus may secure multiple components particularly, when the double cable loop configuration, thereby removing the need for multiple locks for securing a single article. In one exemplary embodiment, the lock apparatus includes a lock housing defining at least one opening and having a channel extending at least partially therethrough, cable selectively attachable to the lock housing and having a cable end positionable within the at least one opening, and being maneuverable between a first orientation where the cable is disposed external of the channel of the lock housing to define a single loop configuration and a second orientation where the cable extends through the channel to define a double loop configuration, a lock member at least partially disposed within the lock housing and positioned adjacent the at least one opening, and being movable between a secured condition securing the first cable end to thereby retain the cable in either the single loop or double loop configuration, and an unsecured condition releasing the first cable end, and a manually movable member operatively coupled to the lock member and movable to permit movement of the lock member between the secured condition and the unsecured condition.

In another exemplary embodiment, the lock apparatus includes a lock housing defining a first opening and a second opening in opposition to the first opening, and having a channel extending at least partially therethrough, a cable having a first cable end positionable within the first opening and a second cable end positionable within the second opening, and being maneuverable between a first orientation where the cable is disposed external of the channel of the lock housing to define a single loop configuration and a second orientation where the cable extends through the channel to define a double loop configuration, a first lock member positioned adjacent the first opening of the lock housing, a second lock member positioned adjacent the second opening of the lock housing, and a manually movable member operatively coupled to the first lock member and to the second lock member. The manually movable member is movable to permit movement of the first and second lock members between respective secured conditions securing the first and second cable ends relative to the lock housing and respective unsecured conditions permitting release of the first and second cable ends relative to the lock housing.

The manually movable member may be a dial configured for rotational movement about an axis, and being rotatable between a locked position corresponding to the secured condition of each of the first and second lock members and an unlocked position corresponding to the unsecured condition of each of the first and second lock members.

A lock shaft may be disposed within the lock housing. The lock shaft is configured to translate generally along the axis when the dial is in the unlocked position to permit movement of the first lock member from the secured condition to the unsecured condition thereof. A lock gear may be disposed within the lock housing and coaxially arranged about the lock shaft. The lock gear is configured to translate generally along the axis when the dial is in the unlocked position to permit movement of the second lock member from the secured condition to the unsecured condition thereof. The lock shaft and the lock gear include cooperating gear structure which is in general axial alignment when the dial is in the unlocked position to permit translating movement of the lock shaft and the lock gear.

The dial may be engageable with the lock gear whereby rotational movement of the dial causes corresponding rotational movement of the lock gear. At least three individual dials and corresponding first, second and third individual lock gears may be provided. Each of the at least three lock gears including gear structure which is in general axial alignment with the gear structure of the lock shaft when the at least three dials are in the respective unlocked positions thereof.

The first and second lock members may be normally biased to respective secured conditions thereof.

The channel of the lock housing may define a serpentine path configured to facilitate frictional engagement with the cable passing through the channel.

The lock apparatus may include a second cable where the second cable has a length different than a length of the first-mentioned cable.

A method for converting a lock apparatus is disclosed. The method includes providing a lock housing having first and second lock members disposed therein and defining a channel therethrough, securing first and second ends of the cable to the respective first and second lock members whereby the cable defines a single loop configuration, releasing at least one of the first and second cable ends from the respective first or second lock member, passing the cable through the channel of the housing to define a double loop configuration and securing the at least one of the first and second cable ends relative to the first or second lock member with the cable in the double loop configuration. The method may include securing at least one item with the cable in the single loop configuration, or alternatively, securing first and second items within individual loops of the cable in the double loop configuration.

Other features of the present disclosure will be appreciated from the following description of same.

BRIEF DESCRIPTION OF THE DRAWINGS

Various embodiments of the present disclosure are described hereinbelow with references to the drawings, wherein.

DETAILED DESCRIPTION

Figure 1:
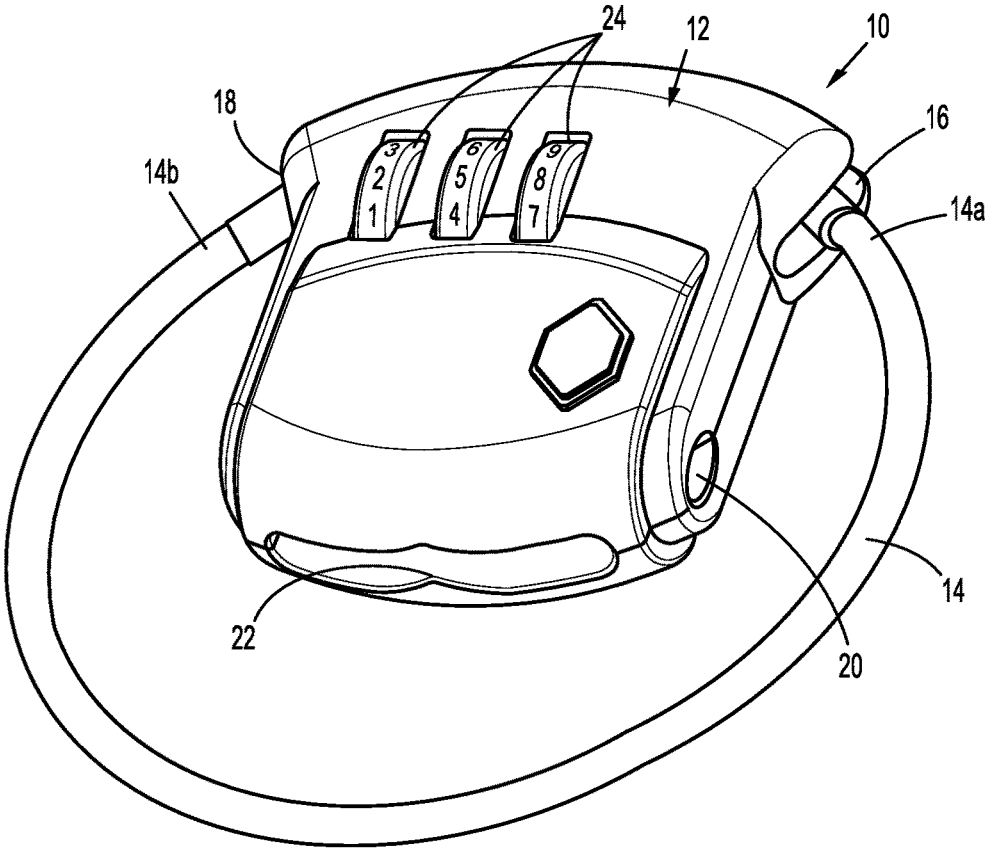
FIG. 1 is a perspective view of the lock apparatus in accordance with the principles of the present disclosure illustrating the lock housing and the cable secured in a single cable loop configuration relative to the lock housing.
Figure 2:
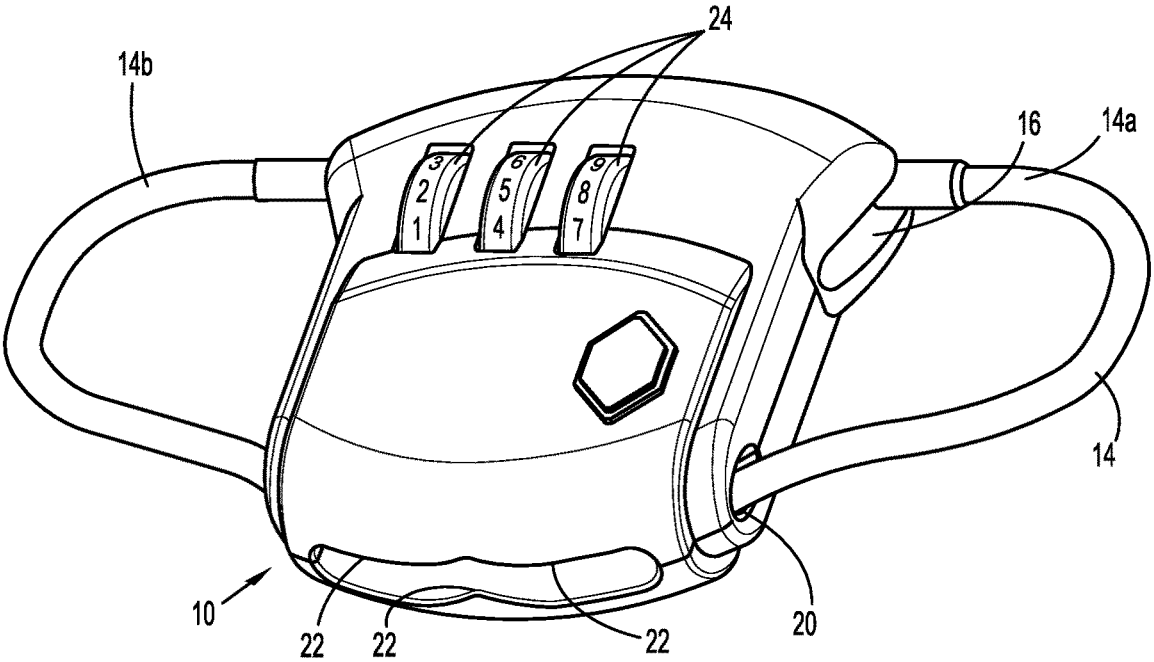
FIG. 2 is a perspective view of the lock apparatus illustrating the cable secured in a double cable loop configuration relative to the lock housing.
Figure 4:
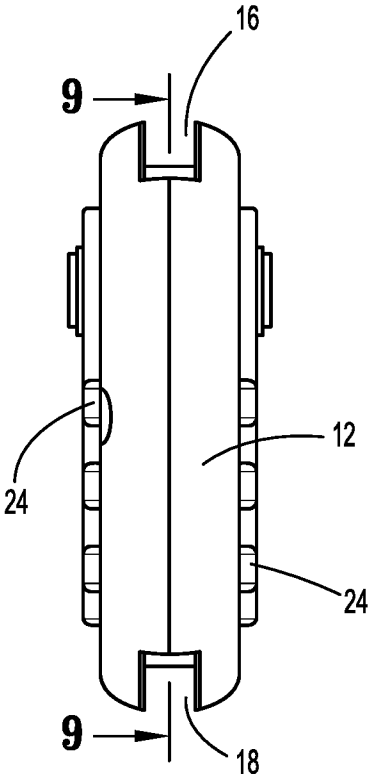
FIG. 4 is an end view of the lock housing.
Figure 3:
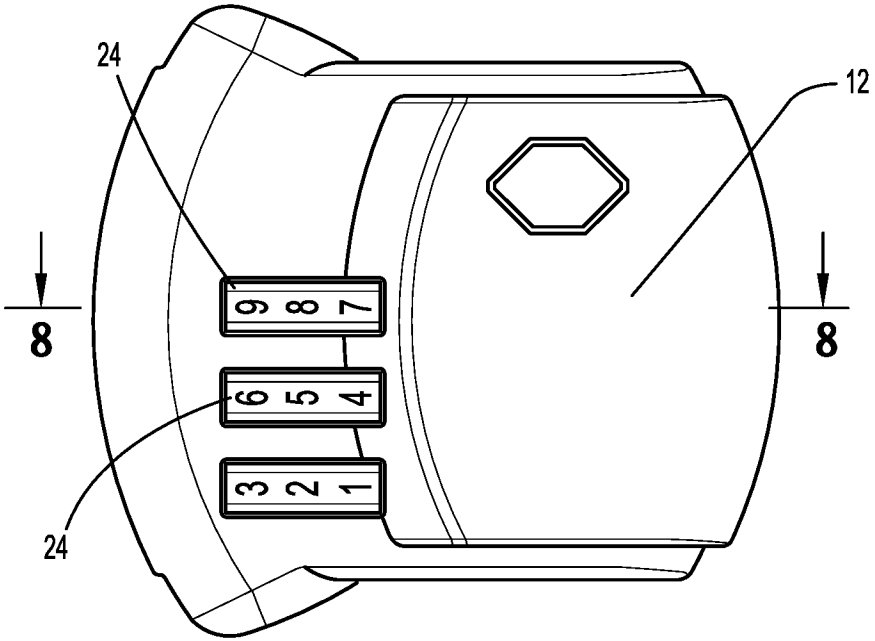
FIG. 3 is a side elevation view of the lock housing of the lock apparatus.
Figure 5:
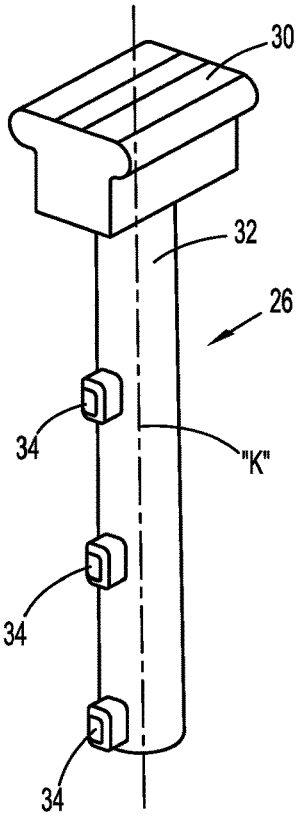
FIGS. 5, 6 and 7 are perspective views of the lock shaft, the lock gear and the dial of the locking mechanism of the lock apparatus.

Referring now to the drawing figures wherein like reference numerals identify similar or like components throughout the several views, FIGS. 1-2 illustrate the portable lock apparatus in accordance with the principles of the present disclosure. The lock apparatus is adapted to selectively transform or convert between a single cable loop configuration (FIG. 1) or a double cable loop configuration (FIG. 2), and incorporates a locking mechanism which facilitates rapid re ease and securement of the cable ends in either configuration. The lock apparatus may be provided with multiple sized cables which may be readily interchanged to accommodate the needs of the user. The lock apparatus may be used in a variety of applications including, but, not limited to, securing luggage, baggage or other personal items.

With reference to FIGS. 1-4, the lock apparatus 10 includes a lock housing 12 and a cable 14 which is mountable or selectively attachable relative the lock housing 12. The lock housing 12 includes diametrically opposed first and second openings 16, 18 for respective reception of first and second cable ends 14*a*, 14*b* of the cable 14 and a channel 20 at least partially extending therethrough for passage of the cable 14 when the lock apparatus 10 is to be used in a double cable loop configuration. The channel 20 may be completely or partially enclosed within the lock housing 12 and may define a serpentine path (FIG. 2) with at least one or more bends or protrusions 22 therein. The serpentine path facilitates frictional engagement of the cable 14 disposed within the channel 20. At least one manually manipulative member or dial 24 is mounted to the lock housing. In one embodiment, three dials 24 are provided. The dials 24 are rotated in accordance with a predefined combination to lock and unlock the locking mechanism. The dials 24 may have alpha or numeric indicia representative of the predefined combination as is conventional in the art.

Figure 6:
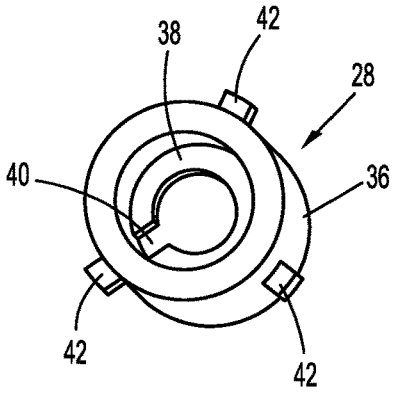
Figure 7:
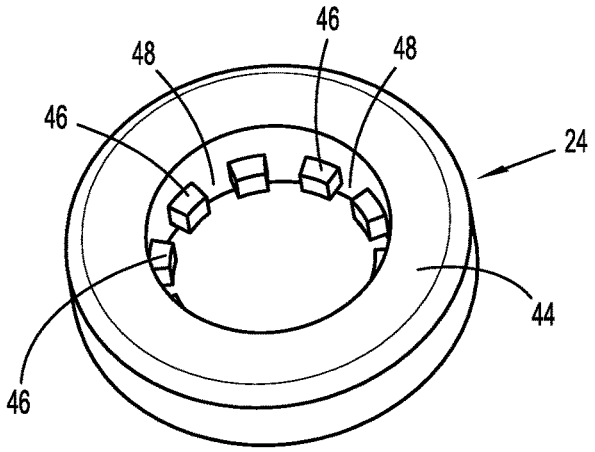

With reference to FIGS. 5-9, the locking mechanism will be discussed. The locking mechanism includes a lock shaft 26, at least one, e.g., three lock gears 28 and the three dials 24. In FIGS. 6 and 7, only one of the lock gears 28 and dials 24 is respectively depicted. The lock shaft 26 includes a head 30 and a shaft segment 32 extending from the head 30 and defining an axis "k". The shaft segment 32 includes gear structure, e.g., in the form of one or more gear teeth 34, arranged along the axis "k" in, e.g., equidistant spaced relation. In an embodiment, three gear teeth 34 are provided to respectively cooperate with the three lock gears 28 and the three dials 24. Each lock gear 28 includes a cylindrical sleeve 36 having an internal wall 38 extending orthogonal with respect to the cylindrical sleeve 36. The internal wall 38 includes gear structure, e.g., in the form of, e.g., a single gear notch 40. The gear notch 40 of each lock gear 28 is configured to permit passage of the gear teeth 34 of the lock shaft 26 when the components are aligned with respect to the axis "k", e.g., upon individual rotation of each of the dials 24 to the predefined combination. Each lock gear 28 further includes three external teeth 42 depending from the periphery of the cylindrical sleeve 36. More or less than three external teeth 42 are envisioned. Each dial 24 includes a collar 44 having a plurality of internal teeth 46 defining recesses 48 therebetween which cooperatively intermesh with the external teeth 42 of the lock gear 28 to operatively couple the dial 24 and the lock gear 28 whereby rotation of the each of the dials 24 causes corresponding rotation of each of the lock gears 28 associated With the dials 24.

Figure 9:
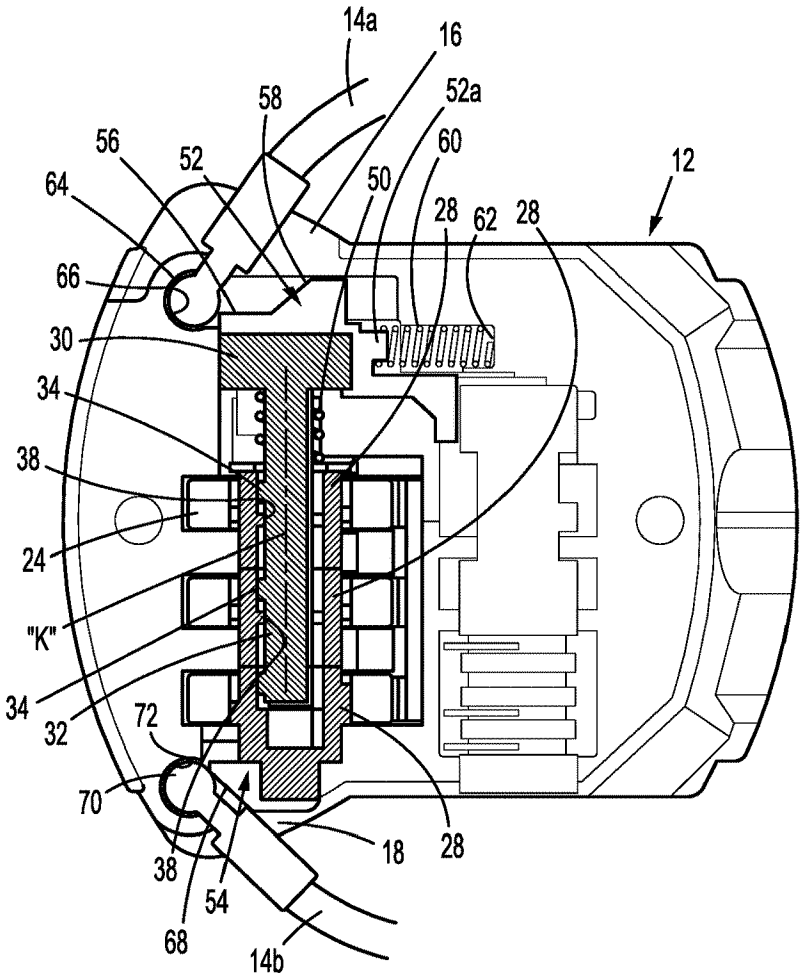
FIG. 9 is a cross-sectional view taken along the lines 9-9 of FIG. 4 illustrating the lock shaft, lock gears and the dials in the locked position of the dials with the first and second locks each in the secured condition engaging first and second cable ends of the cable.
Figure 8:
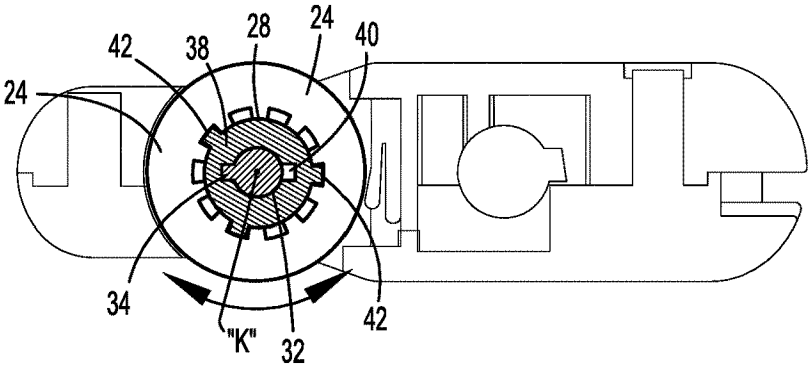
FIG. 8 is a view illustrating the relationship of the lock shaft, gear lock and the dial in the locked position of one dial.

With particular reference to FIGS. 8-9, in the assembled condition, the shaft segment 32 of the lock shaft 26 extends through the lock gears 28, i.e., the lock gears 28 are coaxially mounted about the shaft segment 32 of the lock shaft 26, and the dials 24 are coaxially mounted about the lock gears 28. A coil spring 50 coaxially mounted about the shaft segment 32 of the lock shaft 26 engages the head 30 of the lock shaft 26 and the end of the uppermost lock gear 28 to normally bias the lock shaft 26 and the three lock gears 28 away from each other in different axial directions with respect to the axis "k". In FIGS. 8-9, the dials 24 are in the locked position. In this position, the three gear teeth 34 of the lock shaft 26 are misaligned with respect to the gear notches 40 of the lock gears 28. Thus, the lock shaft 26 and lock gears 28 are fixed from relative movement along the axis "k" via engagement of the gear teeth 34 of the lock shaft 26 with the internal walls 38 of the lock gears 28. FIG. 8 illustrates one dial 24 and associated lock gear 28 with one gear tooth 34 of the lock shaft 26 engaging the internal wall 38 of the lock gear 28. The remaining two dials 24 and associated lock gears 28 are arranged in a similar manner when the dials 24 are in their locked positions.

With continued reference to FIGS. 8-9, the locking mechanism further includes first and second locks 52,54 disposed adjacent the respective first and second openings 16, 18 of the lock housing 12. The first lock 52 includes a lock shelf 56 and a ramp segment 58 depending from the lock shelf 56. The first lock 52 may be normally biased toward the secured condition depicted in FIG. 9 by a coil spring 60 which engages at one end an internal wall 62 within the lock housing 12 and at the other end is positioned about a spring mount 52*a* of the first lock 52. In the alternative, or additionally, the first lock 52 may be biased to the secured condition by the aforementioned coil spring 50 mounted about the shaft segment 32 of the lock shaft 26. For example, the head 30 of the lock shaft 26 resides against the undersurface of the first lock 52 and may transfer the biasing force of the coil spring 50 to the first lock 52 to orient the first lock in the secured condition shown.

In the secured condition, the first lock 52 (e.g., the lock shelf 56 of the first lock 52) securely engages the first cable end 14*a* of the cable 14, e.g., a first ball segment 64 of the first cable end 14*a*. The first ball segment 64 may reside within a correspondingly dimensioned recess 66 within the lock housing 12. The first lock 52 moves at least in an axial direction with respect to the axis "k" to an unsecured condition to release the first ball segment 64 and thus the first cable end 14*a* of the cable 14.

The second lock 54 also may define a ramp segment 68 and is configured, in the secured condition thereof, to securely engage the second cable end 14*b* of the cable 14, e.g., a second ball segment 70 of the cable 14. The second ball segment 70 may reside within a correspondingly dimensioned arcuate recess 72 within the lock housing 12. The second lock 54 is positioned adjacent the lower lock gear 28, and also moves in an axial direction with respect to the axis "k" to an unsecured condition thereof to release the second ball segment 70 and thus the second cable end 14*b* of the cable 14.

Figure 11:
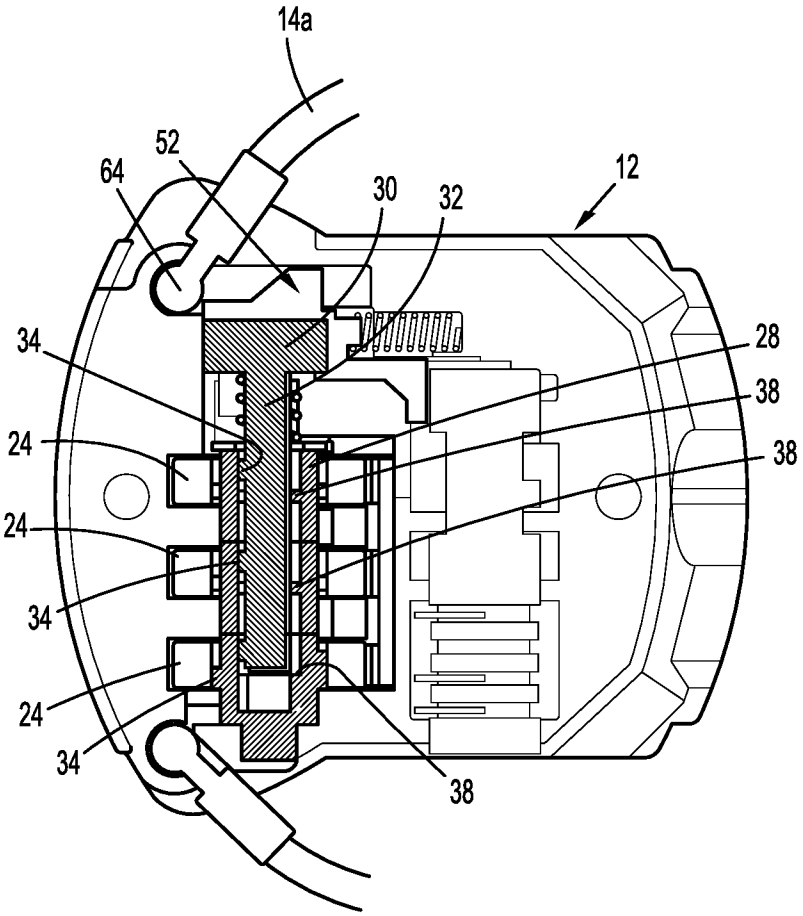
FIG. 11 is a cross-sectional view similar to the view of FIG. 9 further illustrating the relative orientation of the lock shaft and the lock gears with the dials in the unlocked position thereof.
Figure 10:
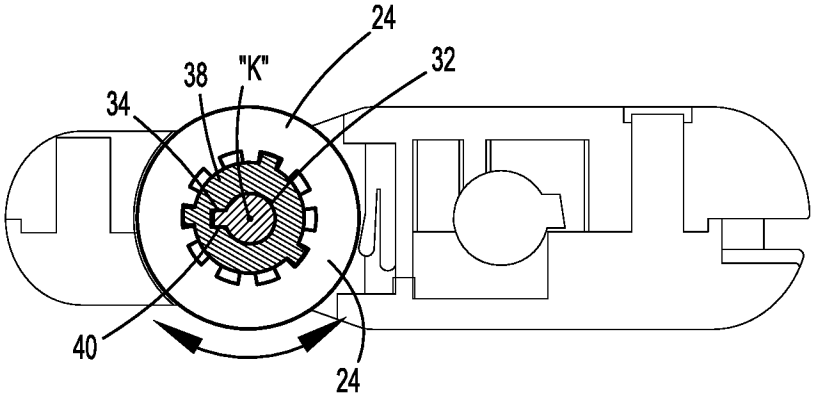
FIG. 10 is a view similar to the view of FIG. 8 illustrating the dial in the unlocked position to permit relative movement of the lock shaft and the lock gears and release of the first and second cable ends.

In operation, and with reference to FIG. 10, each dial 24 is individually rotated about the axis "k" to the predefined combination to correspondingly rotate the respective lock gears 28 to align the single gear notch 40 of each of the lock gears 28 with the gear teeth 34 extending along the shaft segment 32 of the lock shaft 26 (compare with FIG. 8). FIG. 11 further illustrates the aligned condition of the gear teeth 34 of the lock shaft 26 and the gear notches 40 of the lock gears 28. (compare with FIG. 9). In this aligned condition, the lock shaft 26 and the lock gears 28 may move relative to each other and along the axis "k".

Figure 13:
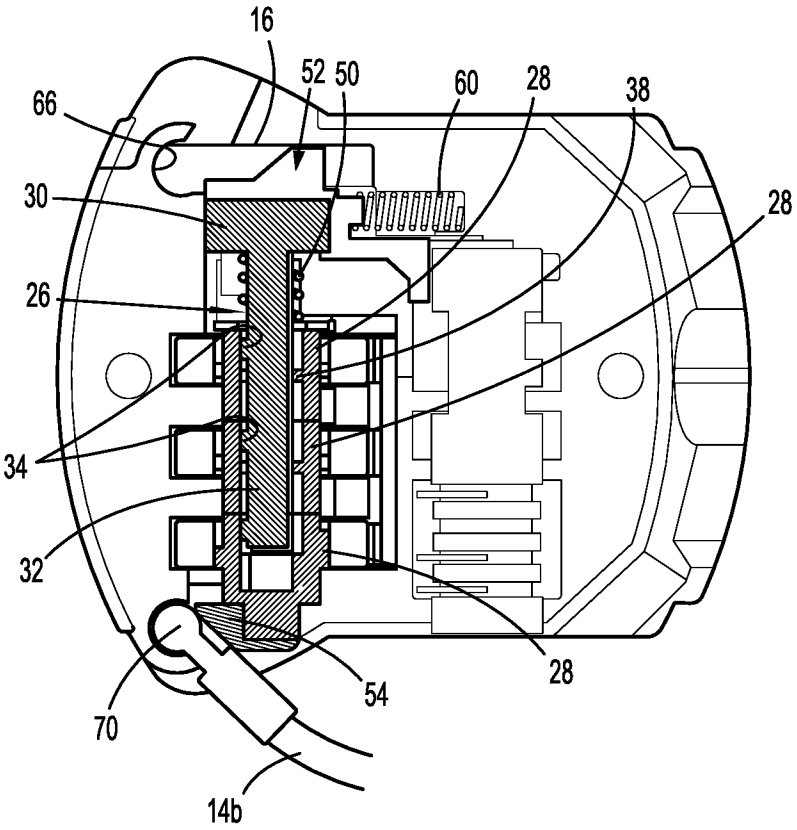
FIG. 13 is a cross-sectional view similar to the view of FIG. 12 illustrating the first cable end removed from the lock housing.
Figure 12:
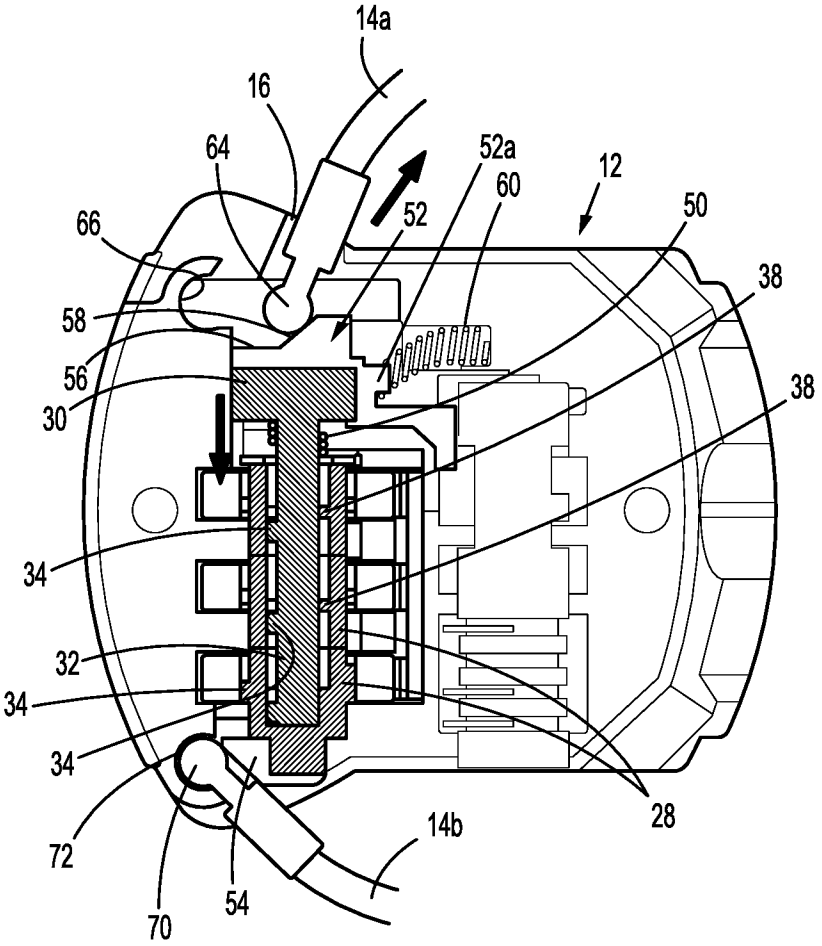
FIG. 12 is a cross-sectional view similar to the view of FIG. 11 illustrating movement of the first lack and the lock shaft to permit release of the first cable end relative to the lock housing.

With reference to FIG. 12, to remove the first ball segment 64 of the first cable end 14*a* from the lock housing 12, the first cable end 14*a* is pulled outwardly relative to the lock housing 12 which causes the first ball segment 64 to engage the ramp segment 58 of the first lock 52 and, via a camming action, drive the first lock 52 and the lock shaft 26 downwardly against the bias of the coil spring 50 and along the axis "k" to permit removal of the first cable end 14*a* through the first opening 16. The incline of the ramp segments 58 also assists in expelling the first ball segment 64 from the first opening 16 in the lock housing 12. The coil spring 60 may flex downwardly but is retained engaged about the spring mount 52*a* of the first lock 52. Once the first cable end 14*a* is removed, the lock shaft 26 returns to its normal position under the influence of coil spring 50 as depicted in FIG. 13. The gear teeth 34 of the lock shaft 26 and the gear notches 40 of the lock gears 28 are still in the aligned condition in that the dials 24 have not been rotated.

Figure 14:
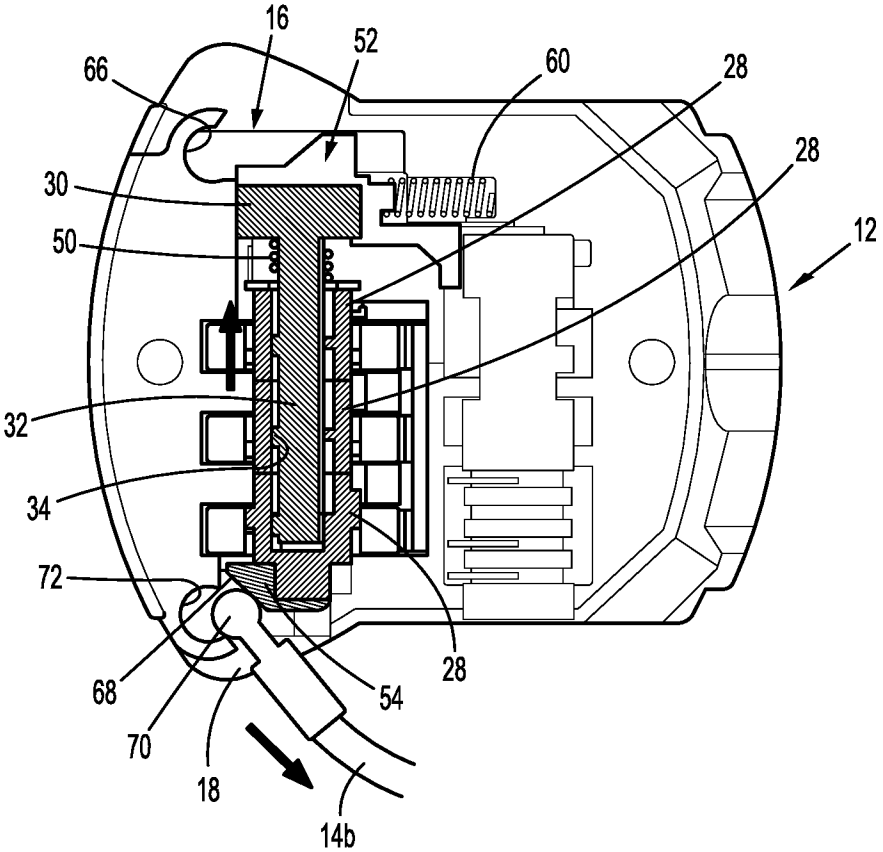
FIG. 14 is a cross-sectional view similar to the view of FIG. 13 illustrating movement of the second lock and the lock gears to permit release of the second cable end relative to the lock housing.

With reference to FIG. 14, the second cable end 14*b* may be removed from the lock housing 12 by pulling on the second cable end 14*b* which causes the second ball segment 70 to engage the ramp segment 68 of the second lock 54 and drive the second lock 54, via a camming action, upwardly to also drive the lock gears 28 upwardly along the axis "k" against the bias of the coil spring 50. The incline of the ramp segment 68 also assists in driving the second ball segment 70 from the second opening 18 of the lock housing 12. With the first and second cable ends 14*a*, 14*b* released, either or both of the first and second cable ends 14*a*, 14*b* may be looped within or about a personal item and reintroduced within the respective first and second openings 16, 18 of the lock housing 12. The first and second cable ends 14*a*, 14*b* may then be secured by rotating the dials 24 to cause misalignment of the gear notches 40 of the lock gears 28 with the gear teeth 34 of the lock shaft 26. In an alternate methodology, only one of the first and second cable ends 14*a*, 14*b* may be released relative to the lock housing 12, passed through or about the personal item and reintroduced within the respective first or second opening 16, 18 of the lock housing 12.

Figure 15:
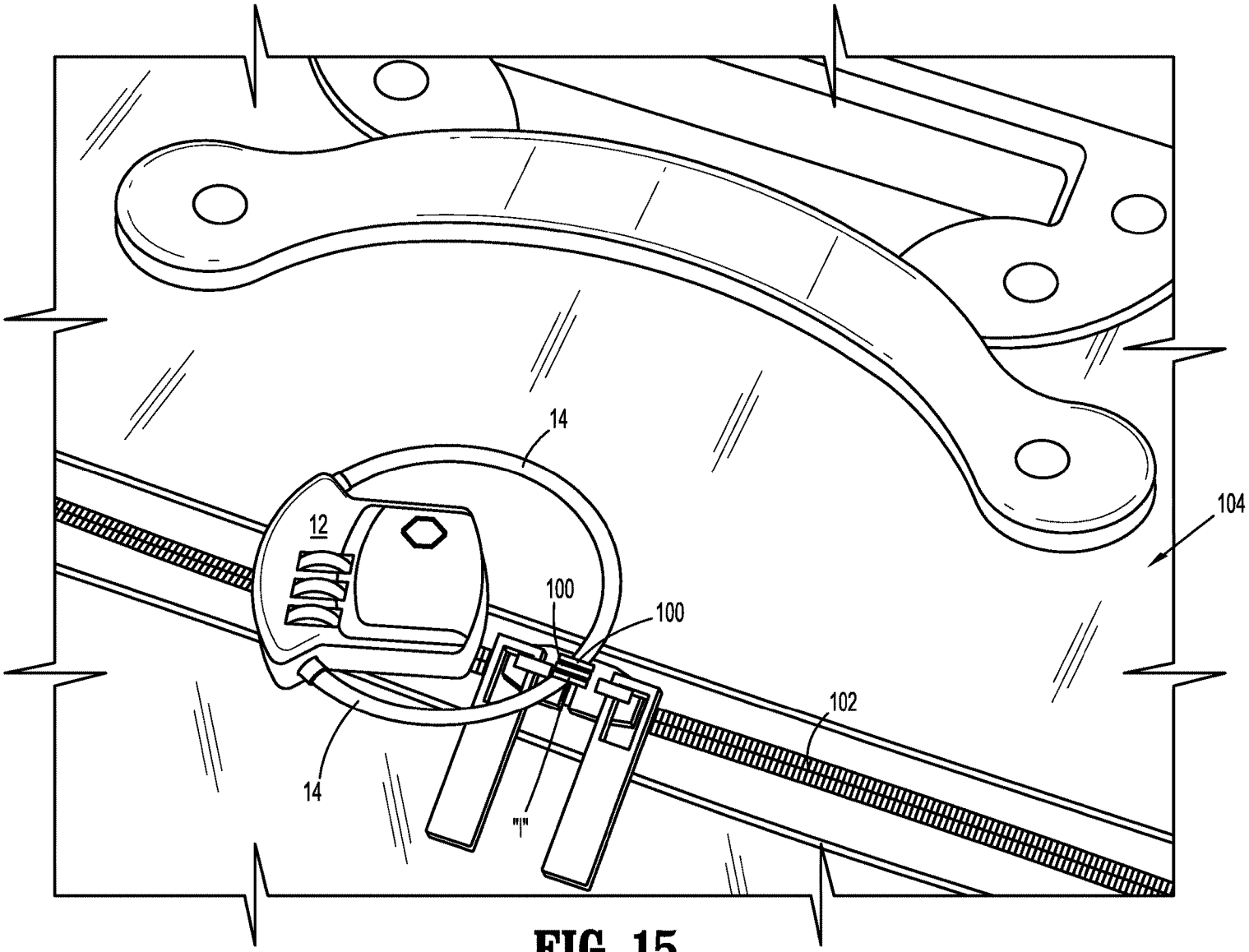
FIG. 15 is a view illustrating the lock apparatus with the cable secured in the single loop configuration locking together adjacent zipper handles of luggage

The use of the lock apparatus 10 will now be discussed. When it is desired to utilize the lock apparatus 10 in a single cable loop configuration, either the first cable end 14*a* or the second cable end 14*b*, or both, may be released from the lock housing 12 in the aforedescribed manner, e.g., via rotating the dials 24 to the predefined combination. The cable 14 may then be looped about or within an item such as loops "l" of adjacent zipper heads 100 of a zipper 102 of luggage 104 as depicted in FIG. 15. The removed cable end 14*a*, 14*b* may be reintroduced within the respective first or second opening 16, 18 of the lock housing 12 and secured via rotation of the dials 24 to the locked position.

Figure 16A:
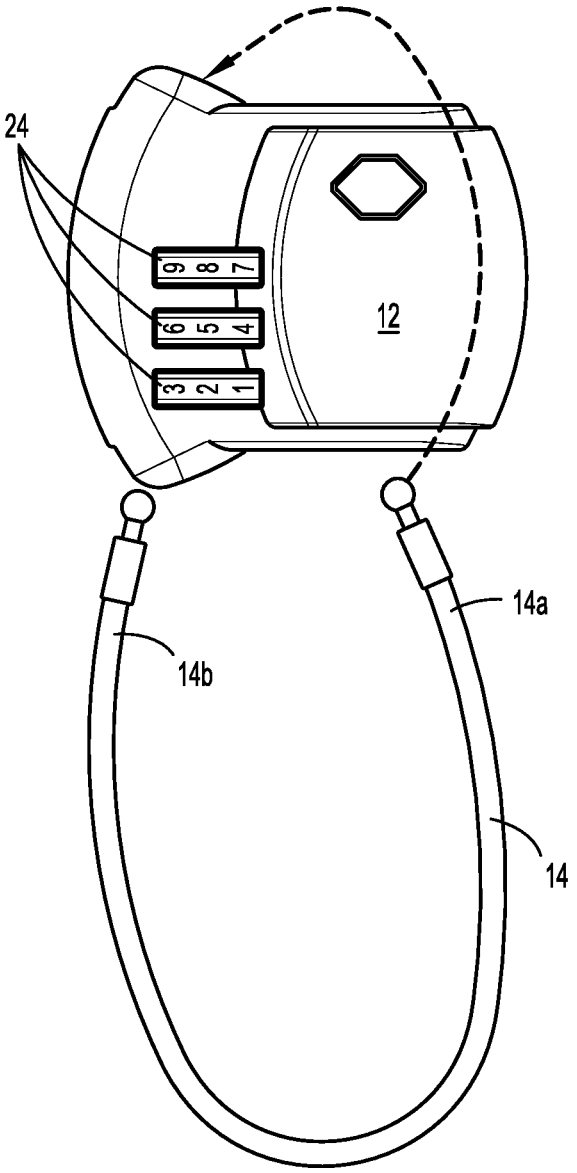
FIGS. 16A-16B are views illustrating introduction of the cable through the channel of the lock housing to establish a double cable loop configuration of the cable.
Figure 16B:
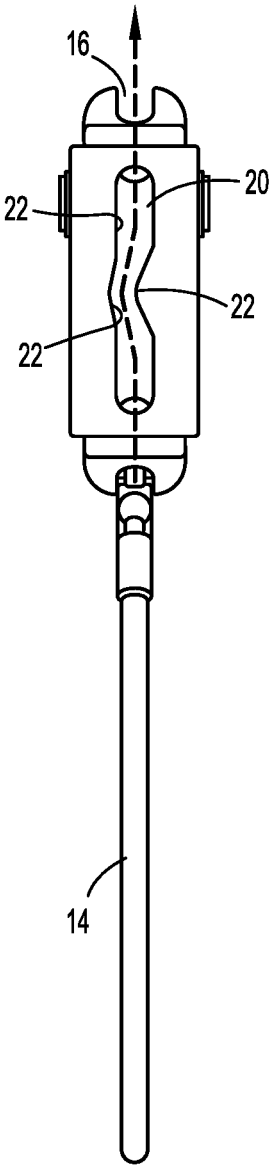
Figure 17A:
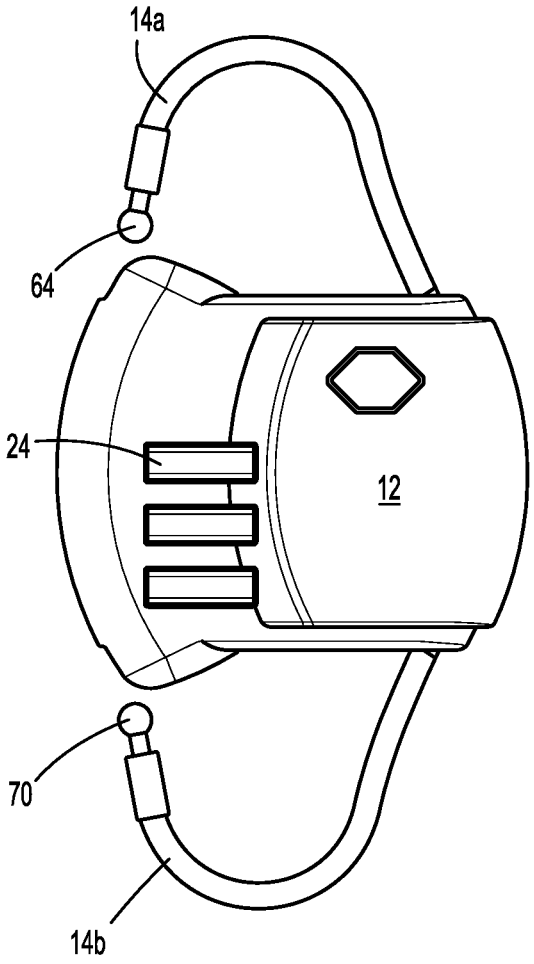
FIGS. 17A-17B are views illustrating the first and second cable ends secured relative to the lock housing with the cable passing through the channel of the lock housing.
Figure 17B:
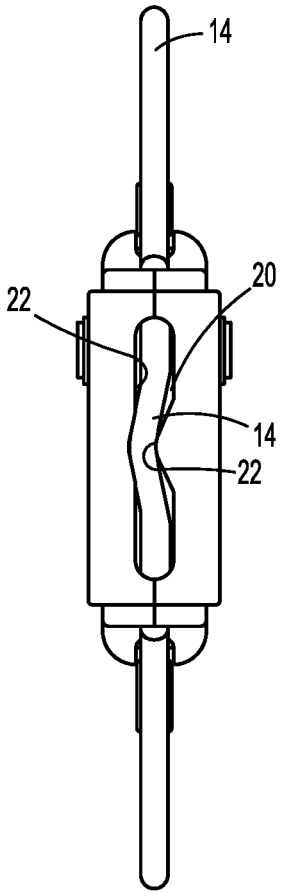
Figure 18:
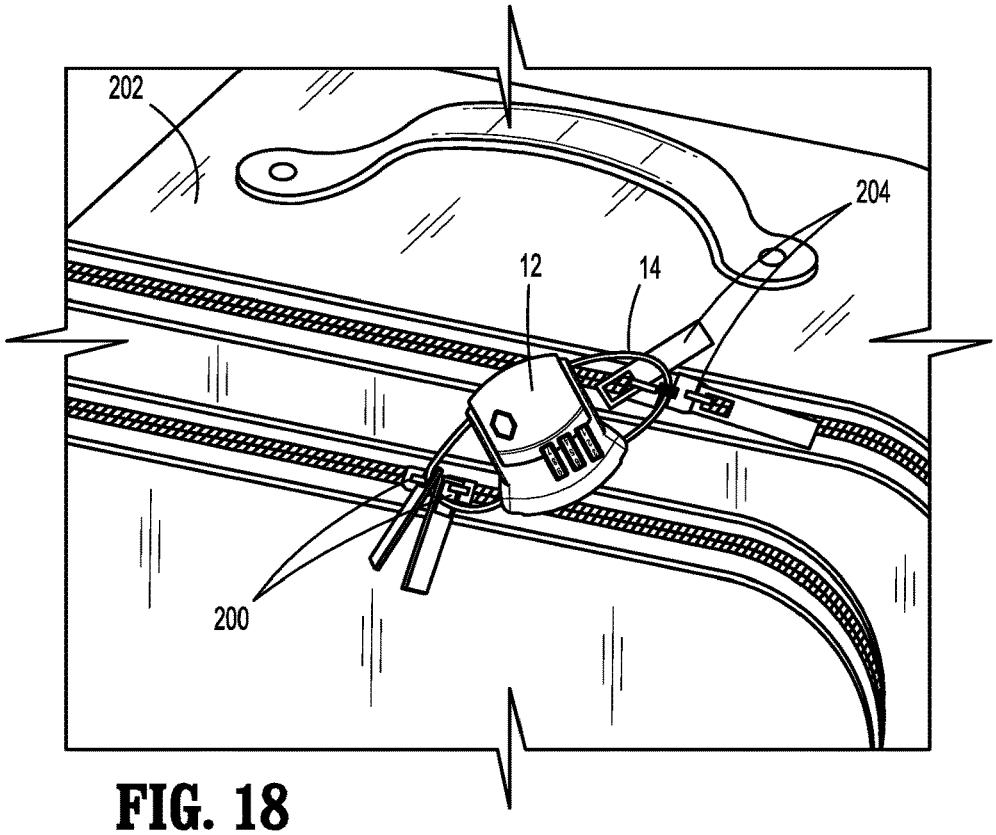
FIG. 18 is a view illustrating the lock apparatus with the cable secured in the double loop configuration locking two spaced pairs of adjacent zipper handles of luggage.

When it is desired to utilize the lock apparatus 10 in a double loop configuration, the first and second cable ends 14*a*, 14*b* are released from the lock housing 12. The cable 14 is then introduced within the channel 20 of the lock housing 12 as depicted in FIGS. 16A-16B and passed through the channel 20 to establish desired loop lengths of the double cable loop configuration (17A-17B). The serpentine path and bends or protrusions 22 within the channel 20 thereby assist in frictionally engaging the cable 14 to maintain the relative positioning of the cable 14 and the lock housing 12 at the desired loop lengths of the double cable loop configuration, e.g., preventing undesired sliding movement of the cable 14 relative to the lock housing 12. The first cable end 14*a* may be passed through adjacent items such as an adjacent first pair of zipper heads 200 of luggage 202 depicted in FIG. 18, and the second cable end 14*b* passed through an adjacent second pair of zipper heads 204 of a different section of the luggage 202. The first and second cable ends 14*a*, 14*b* are reinserted within the respective first and second openings 16, 18 and the dials 24 are rotated to their locked positions locking the first and second ball segments 64, 70 of the first and second cable ends 14*a*, 14*b* with the first and second locks 52, 54 respectively. In an alternate methodology, only one of the first and second cable ends 14*a*, 14*b* may be released relative to the lock housing 12, and the released cable portion may be looped through, e.g., the first pair of zipper heads 200, passed through the channel 20 of the lock housing 12, looped through the second pair of zipper heads 204, and reintroduced within the respective opening 16, 18 of the lock housing for securement therein.

Figure 19:
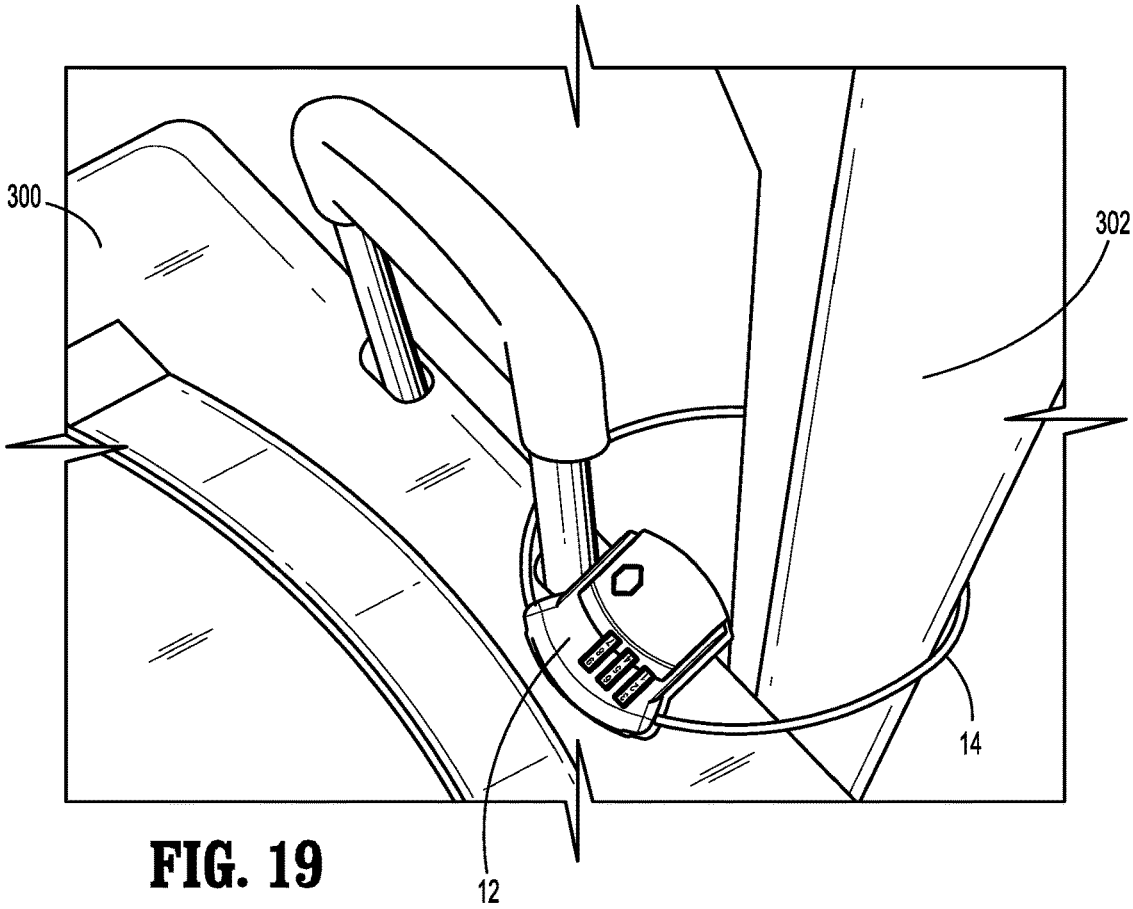
FIG. 19 is a view illustrating the lock apparatus securing the handle of luggage to a support.

FIG. 19 illustrates use of the lock apparatus in securing a briefcase or luggage 300 to structure 302 with a single loop configuration of the cable 14. The length of the cable 14 in this embodiment is greater than the length of the cable 14 in prior embodiments.

The lock apparatus 10 may be provided as a kit including at least two cables 14 of different lengths and the lock housing 12 to enhance flexibility for the user. In addition, the predefined combination of the dials 24 may be changed as desired by the user. In particular, with the first and second cable ends 14*a*, 14*b* removed from the lock housing 12 and with the lock gears 28 and the lock shaft 26 in the aligned and unlocked orientation, the user may push upwardly on the second lock 54 to displace the lock gears 28 along the axis "k" such that the external teeth 42 of the lock gears 28 are disengaged from the internal teeth 46 of the dials 24. In this position, the dials 24 may be rotated to a desired alpha or numeric combination and the second lock is released permitting the lock gears 28 to return under the influence of the cod spring 50 to their normal position with the new combination intact.

It is further envisioned that one of the first and second cable ends 14*a*, 14*b* may be permanently secured to the lock housing 12. For example, the second cable end 14*b* may be secured through conventional methodologies to the lock housing 12 and the first cable end 14*a* may be releasably secured to the lock housing 12 via the first lock 52. In this embodiment, the lock gears 28 do not need to translate along the axis "k". The lock apparatus 10 of this embodiment may be utilized to secure the cable in either the single loop or double loop configuration.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A lock apparatus, which comprises:

a lock housing defining at least one opening and having a channel extending at least partially therethrough;

a cable selectively attachable to the lock housing and having a cable end positionable within the at least one opening, the cable maneuverable between a first orientation where the cable is disposed external of the channel of the lock housing to define a single loop configuration and a second orientation where the cable extends through the channel to define a double loop configuration;

a lock member at least partially disposed within the lock housing and positioned adjacent the at least one opening, the lock member movable between a secured condition securing the first cable end to thereby retain the cable in either the single loop or double loop configuration, and an unsecured condition releasing the first cable end; and a manually movable member operatively coupled to the lock member and movable to permit movement of the lock member between the secured condition and the unsecured condition;

wherein the channel is isolated from the lock member.

2. The lock apparatus according to claim 1 wherein the channel of the lock housing is configured such that a cable segment extending through the channel, when in the second orientation of the cable, is free from engagement with the lock member when the lock member is in each of the secured condition and the unsecured condition thereof.

3. The lock apparatus according to claim 1 wherein the lock member is normally biased to the secured condition.

4. A lock apparatus, which comprises:

a lock housing defining a first opening and a second opening in opposition to the first opening, the lock housing having a channel extending at least partially therethrough;

a cable having a first cable end positionable within the first opening and a second cable end positionable within the second opening, the cable maneuverable between a first orientation where the cable is disposed external of the channel of the lock housing to define a single loop configuration and a second orientation where the cable extends through the channel to define a double loop configuration;

a first lock member positioned adjacent the first opening of the lock housing;

a second lock member positioned adjacent the second opening of the lock housing; and a manually movable member operatively coupled to the first lock member and to the second lock member, the manually movable member movable to permit movement of the first and second lock members between respective secured conditions securing the first and second cable ends relative to the lock housing and respective unsecured conditions permitting release of the first and second cable ends relative to the lock housing, wherein the channel is isolated from the lock member;

wherein the channel is isolated from the first and second lock members.

5. The lock apparatus according to claim 4 wherein the manually movable member is a dial, the dial configured for rotational movement about an axis, the dial rotatable between a locked position corresponding to the secured condition of each of the first and second lock members and an unlocked position corresponding to the unsecured condition of each of the first and second lock members.

6. The lock apparatus according to claim 5 including a lock shaft disposed within the housing, the lock shaft configured to translate generally along the axis when the dial is in the unlocked position to permit movement of the first lock member from the secured condition to the unsecured condition thereof.

7. The lock apparatus according to claim 6 including a lock gear disposed within the housing and coaxially arranged about the lock shaft, the lock gear configured to translate generally along the axis when the dial is in the unlocked position to permit movement of the second lock member from the secured condition to the unsecured condition thereof.

8. The lock apparatus according to claim 7 wherein the lock shaft and the lock gear include cooperating gear structure which is in general axial alignment when the dial is in the unlocked position to permit translating movement of the lock shaft and the lock gear.

9. The lock apparatus according to claim 8 wherein the dial is engageable with the lock gear whereby rotational movement of the dial causes corresponding rotational movement of the lock gear.

10. The lock apparatus according to claim 9 including at least three individual dials and corresponding at least three individual lock gears respectively coupled to the at least three dials, each of the at least three lock gears including gear structure winch is in general axial alignment with the gear structure of the lock shaft when the at least three dials are in the respective unlocked positions thereof.

11. The lock apparatus according to claim 8 wherein the first and second lock members are each normally biased to respective secured conditions thereof.

12. The lock apparatus according to claim 4 wherein the channel defines a serpentine path configured to facilitate frictional engagement with the cable passing through the channel.

13. The lock apparatus according to claim 4 including a second cable, the second cable having a length different than a length of the first-mentioned cable.

14. The lock apparatus according to claim 4 wherein the channel of the lock housing is configured such that a cable segment extending through the channel, when in the second orientation of the cable, is free from engagement with each of the first and second lock members when in each of the secured condition and the unsecured condition thereof.

15. A method for converting a lock apparatus, comprising:

providing a lock housing including first and second lock members disposed therein and defining a channel therethrough, the channel being isolated from the first and second lock members;

securing first and second ends of a cable to the respective first and second lock members whereby the cable defines a single loop configuration;

releasing at least one of the first and second cable ends from the respective first or second lock member;

passing the cable through the channel of the housing to define a double loop configuration; and securing the at least one of the first and second cable ends relative to the first or second lock member with the cable in the double loop configuration.

16. The method according to claim 15 including securing at least one item with the cable in the single loop configuration.

17. The method according to claim 15 including securing first and second items within individual loops of the cable in the double loop configuration.

18. The method according to claim 15 including releasably securing the first and second ends of the cable to the respective first and second lock members.

19. The method according to claim 15 wherein passing the cable includes isolating a cable segment within the channel from each of the first and second lock members.

20. The method according to claim 15 including providing at least one protrusion within the channel configured to facilitate frictional engagement with the cable passing through the channel.

* * * * *